US007725956B1

(12) United States Patent
Berokoff

(10) Patent No.: US 7,725,956 B1
(45) Date of Patent: Jun. 1, 2010

(54) GOLF GLOVE WITH CLUB HANDLE STOP

(76) Inventor: Andrew J. Berokoff, 13922 Valna Ave., Whittier, CA (US) 89695

( * ) Notice: Subject to any disclaimer, the term of this patent is extended or adjusted under 35 U.S.C. 154(b) by 0 days.

(21) Appl. No.: 12/333,059

(22) Filed: Dec. 11, 2008

(51) Int. Cl.
*A41D 19/00* (2006.01)

(52) U.S. Cl. ..... 2/161.1; 473/205

(58) Field of Classification Search ..... 2/161.1–161.3; 473/201, 204, 205
See application file for complete search history.

(56) References Cited

U.S. PATENT DOCUMENTS

| | | | | | |
|---|---|---|---|---|---|
| 2,270,882 | A * | 1/1942 | Link | 2/159 |
| 2,447,328 | A | 8/1948 | Gerrits | |
| 2,456,678 | A | 12/1948 | Cole | |
| 3,496,573 | A | 2/1970 | Kuchar et al. | |
| 3,863,271 | A * | 2/1975 | Moroney | 2/161.2 |
| 4,000,903 | A | 1/1977 | Swanson | |
| 4,329,741 | A | 5/1982 | Bach | |
| 5,253,367 | A | 10/1993 | Lappley | |
| 5,634,214 | A | 6/1997 | St. Ville | |
| 5,704,845 | A * | 1/1998 | Boyte | 473/205 |
| 5,855,022 | A * | 1/1999 | Storto | 2/161.2 |
| 5,983,397 | A * | 11/1999 | Seminara | 2/161.1 |
| 6,772,442 | B2 * | 8/2004 | Erker | 2/161.2 |
| 7,058,984 | B2 | 6/2006 | Newman | |

* cited by examiner

*Primary Examiner*—Katherine Moran
(74) *Attorney, Agent, or Firm*—Kenneth L. Green

(57) ABSTRACT

A golf glove provides a positive stop for the end of a golf club handle and a resilient pad for seating the golf club handle against the glove. The stop reaches across the glove palm and angles towards the small finger and has a wall extending perpendicular to the wearer's palm for the handle to abut against. The resilient pad fills a concave portion of the palm to provide a substantially flat surface for the golf club handle to seat against.

13 Claims, 5 Drawing Sheets

GOLF GLOVE WITH CLUB HANDLE STOP

BACKGROUND OF THE INVENTION

The present invention relates to golf gloves and in particular to a golf glove with a golf club handle stop.

In many sports utilizing hitting or driving implements, achieving a consistent grasp of the implement is important in success. Especially in golf, a slight error in the angle of hitting the ball may result in a disastrous shot. Generally, the handle of the golf club extends through the golfer's hands, and the precise position of the golfer's hands on the golf club handle may be difficult to repeat. Further, a golfer's grip on the club handle may be limited when the handle can slide against the golf glove's surface.

BRIEF SUMMARY OF THE INVENTION

The present invention addresses the above and other needs by providing a golf glove which provides a positive stop for the end of a golf club handle and a resilient pad for seating the golf club handle against the glove. The stop reaches across the glove palm and angles towards the small finger and has a wall extending perpendicular to the wearer's palm for the handle to abut against. The resilient pad fills a concave portion of the palm to provide a substantially flat surface for the golf club handle to seat against.

In accordance with one aspect of the invention, there is provided a golf glove for stabilizing a golf club handle. The golf glove includes a stop attached to the golf glove and is positionable on a palm of the golfer's hand, a wall of the stop facing the golfer's fingers, and resilient pad attached to the golf glove. The stop reaches across the palm from near the base of the golfer's thumb and angled away from the horizontal towards the base of the small finger when the fingers are pointed downwards. The wall is approximately perpendicular to the golfer's palm when the golf glove is worn on the golfer's hand. The resilient pad extends from a wide end of the resilient pad proximal to the face of the stop to a narrow end of the resilient pad residing along an index finger of the golfer wearing the golf glove and fills a gap between the golfer's palm and the golf club handle to provide a firm grasp.

In accordance with another aspect of the invention, there is provided a palm harness for stabilizing a golf club handle in a golfer's hand. The palm harness includes a first strap circling the golfer's hand just below the base of the golfer's thumb and a second strap circling the golfer's hand just above the base of the golfer's thumb and is engaged by an index finger of the golfer's hand when worn on the golfer's hand for correctly positioning the palm harness on the palm of the golfer's hand. A stop attached to the palm harness and positionable on the palm of the golfer's hand reaching across the palm from near the base of the golfer's thumb and angled away from the horizontal towards the base of the small finger when the fingers are pointed downwards. A wall of the stop faces the golfer's fingers and is approximately perpendicular to the golfer's palm when the golf glove is worn on the golfer's hand. A resilient pad is attached to the palm harness and extends from a wide end of the resilient pad proximal to the face of the stop to a narrow end of the resilient pad residing along an index finger of the golfer wearing the palm harness.

The resilient pad fills a gap between the golfer's palm and the golf club handle to provide a firm grasp.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
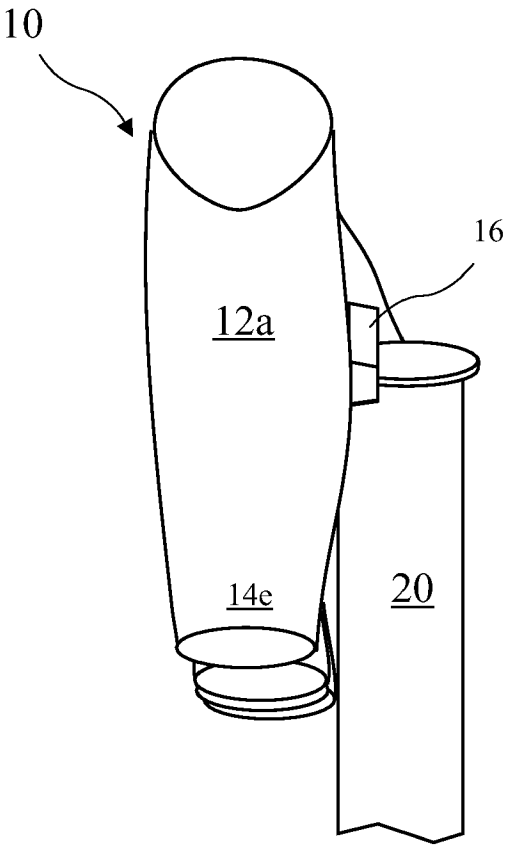
FIG. 1B is a side view of the golf glove with the end of a golf club handle abutted against the stop attached to the golf glove.
Figure 1A:
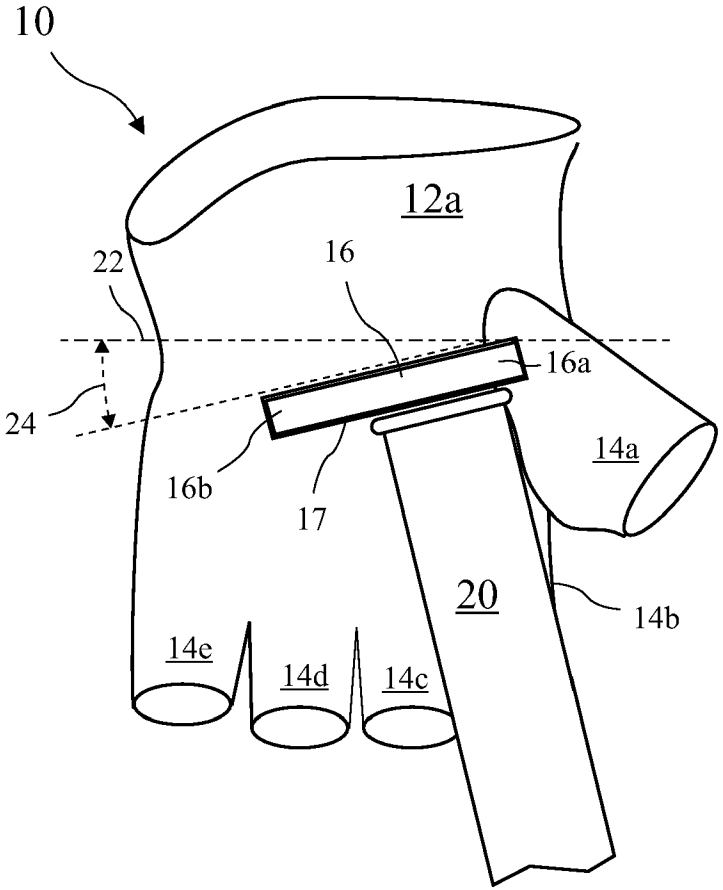
FIG. 1A is a front view of a golf glove with an end of a golf club handle abutted against a stop according to the present invention attached to the golf glove.

A front view of a golf glove 10 with an end of a golf club handle 20 abutted against a stop 16 according to the present invention is shown in FIG. 1A and a side view of the golf glove 10 with the end of a golf club handle 20 abutted against a face 17 of the stop 16 is shown in FIG. 1B. The stop 16 is attached to a glove body 12*a* of the glove 10 and has a first end 16*a* proximal to the base of a thumb sleeve 14*a* and a second end 16*b* angled towards a smallest finger sleeve 14*e*. The handle 20 is seen to rest against an extended index finger sleeve 14*b* next to center and small fingers 14*c* and 14*d* respectively. The stop 16 is long enough to allow the golfer to position the base of the golf club handle 20 next to the golfer's thumb, for example, for putting, or to angle the golf club handle 20 somewhat across the golfer's hand, for example, for chipping. A corresponding length of the stop 16 is preferably between two and three inches long.

The finger sleeve 14*b* for the index finger reaches approximately to the distal joint of the index finger 15*b* (see FIG. 4B) when the glove 10 is worn. A horizontal line 20 runs horizontally across the palm just below (with the fingers pointed down as in FIG. 1A) the base of the thumb sleeve 14*a* and the stop 16 is seen to be angled down at an angle 24. The angle 24 is preferably between zero and fifteen degrees and more preferably between three and fifteen degrees. The face 17 is approximately perpendicular to the palm of a golfer wearing the glove 10 and is sufficiently perpendicular to the palm to prevent the end of the golf club handle from easily slipping off of the stop 17 when the golf club handle 20 is laying against the glove 10.

Figure 2A:
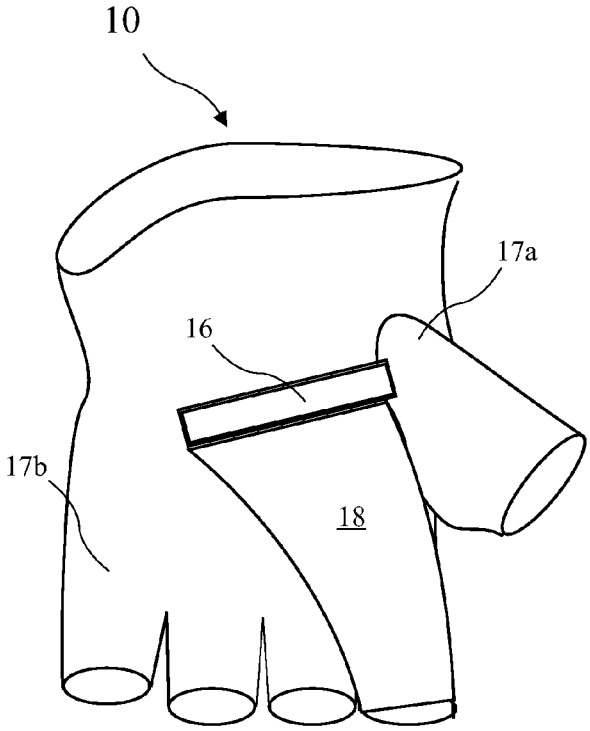
FIG. 2A is a front view of the golf glove with a resilient pad according to the present invention for filling a gap between the golfer's palm and the golf club handle.
Figure 2B:
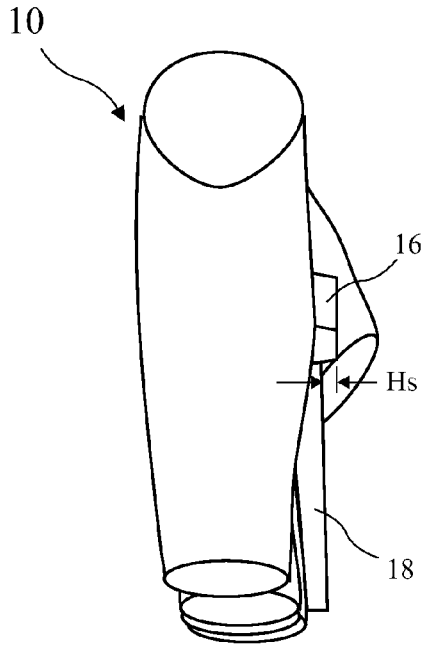
FIG. 2B is a side view of the golf glove with the resilient pad according to the present invention for filling the gap between the golfer's palm and the golf club handle.
Figure 3A:
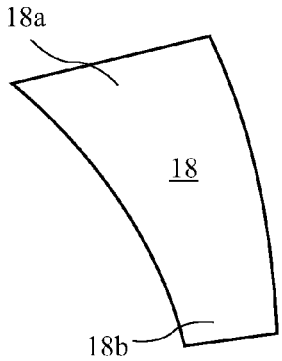
FIG. 3A is a front view of the resilient pad according to the present invention for filling a gap between the golfer's palm and the golf club handle.
Figure 3B:
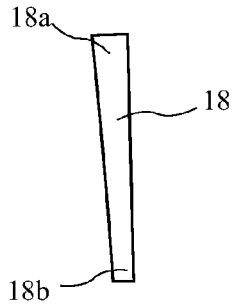
FIG. 3B is a side view of the resilient pad according to the present invention for filling the gap between the golfer's palm and the golf club handle.
Figure 3C:
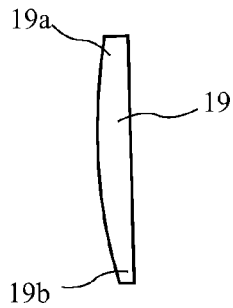
FIG. 3C is a side view of a second resilient pad with a convex base according to the present invention for filling the gap between the golfer's palm and the golf club handle.

A front view of the golf glove 10 with a resilient pad 18 according to the present invention for filling a gap between the golfer's palm and the golf club handle 20 is shown in FIG. 2A and a side view of the golf glove 10 with the resilient pad 18 is shown in FIG. 2B. An additional front view of the resilient pad 18 alone is shown in FIG. 3A, a side view of the resilient pad 18 alone is shown in FIG. 3B, and a side view of a second resilient pad 19 having a convex base is shown in FIG. 3C. The resilient pad 18 has a wide end 18*a* proximal to the stop 16 and tapers down to a narrow end 18*b* extending along the index finger sleeve 14*b* (see FIG. 1A). The narrow end 18*a* is about even with the distal joint of the index finger when the glove 10 is warn on the golfer's hand.

The resilient pad 18 or 19 provides a better surface for the golf club handle to seat against. The resilient pad 18 may be made of a variety of compressible material and the cooperation of the compressibility and the thickness of the resilient pad 18 is preferably sufficient to allow the resilient pad 18 to compress sufficiently to provide contact of the golf club handle 20 with the entire length of a top surface of the resilient pad 18. The convex base of the second resilient pad 19 fills a hollow of the golfer's palm to provide a flat top surface for the golf club handle to rest against for a secure grip and therefore does not need to compress as much as the resilient pad 18. The wide end of the resilient pad 18 is preferably between ⅜ inches to ¾ inches thick and preferably between 1.5 and three inches wide and the narrow end 18*b* of the resilient pad is preferably between 3/16 inches to 5/16 inches thick and preferably between ¾ and 1.5 inches wide. More preferably, the wide end of the resilient pad is about 2.5 inches wide and the narrow end of the resilient pad is about one inch wide. The resilient pad may be made from a variety of compressible materials such as foam, and is compressed to allow the golf club handle 20 to be firmly held against the golfer's hand and fills the cupped area of the golfer's palm. The wide end 18*a* is about as wide as the stop 16 and such width allows the golfer some variation in how the golf club handle is positioned on the golfer's palm. The stop 16 preferably has a height Hs (see FIG. 2B), above the resilient pad 18, of at least ¼ inches and more preferably of at least ⅜ inches, to resist or prevent the golf club handle 20 from slipping off the stop 16.

Figure 4B:
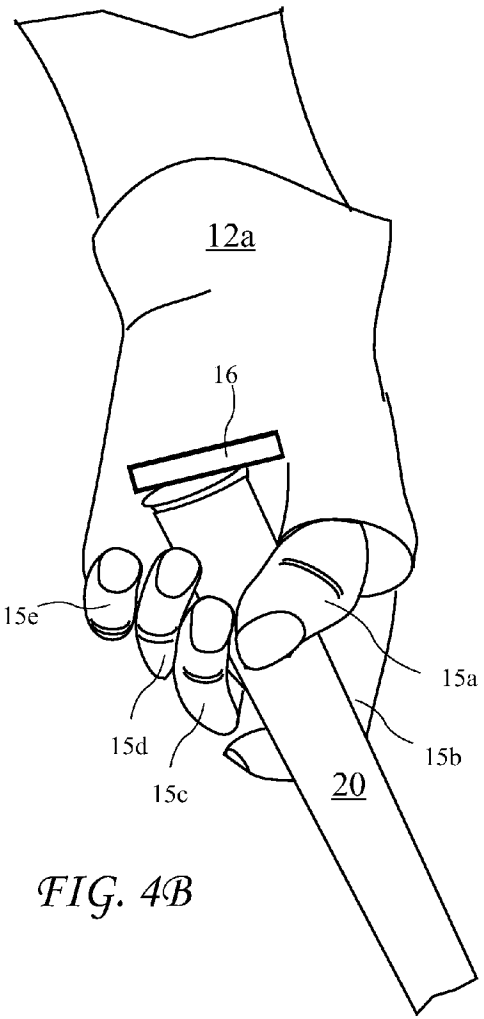
FIG. 4B shows a second grasp according to the present invention with the golf club handle abutted against the stop and the index finger wrapped around the golf club handle.
Figure 4A:
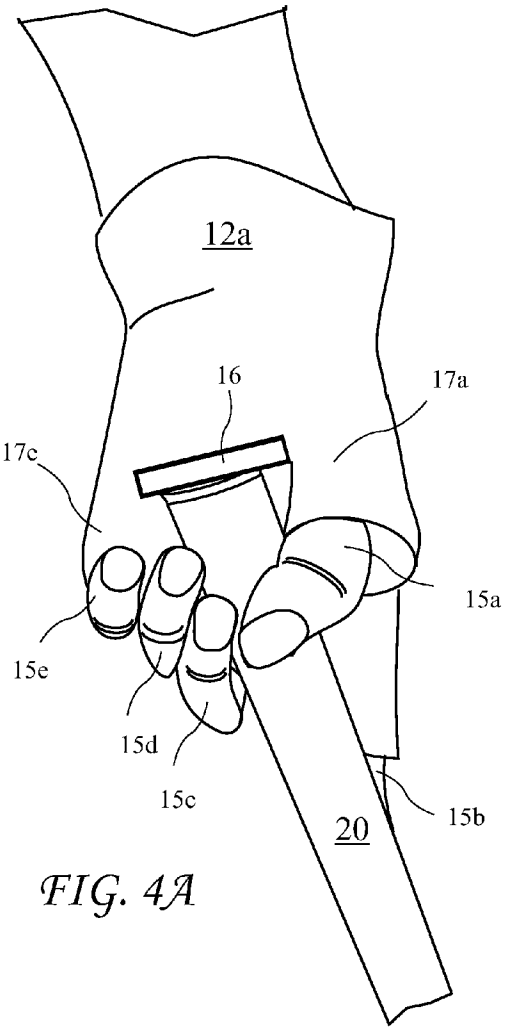
FIG. 4A shows a first grasp according to the present invention with the golf club handle abutted against the stop and an index finger extending along the golf club handle.

A first method for grasping the golf club handle according to the present invention with the golf club handle 20 abutted against the stop 16 and an index finger 15*b* extending along the golf club handle 20 is shown in FIG. 4A and a second method for grasping the golf club handle according to the present invention with the golf club handle 20 abutted against the stop 16 and the index finger 15*b* wrapped around the golf club handle 20 is shown in FIG. 4B. The thumb 15*a* and remaining finger 15*c*-15*e* may be used to grasp the golf club handle 20 in a manner comfortable to the golfer. Either method may be used with a glove with or without the resilient pad 18 (see FIGS. 2A and 2B).

Figure 5A:
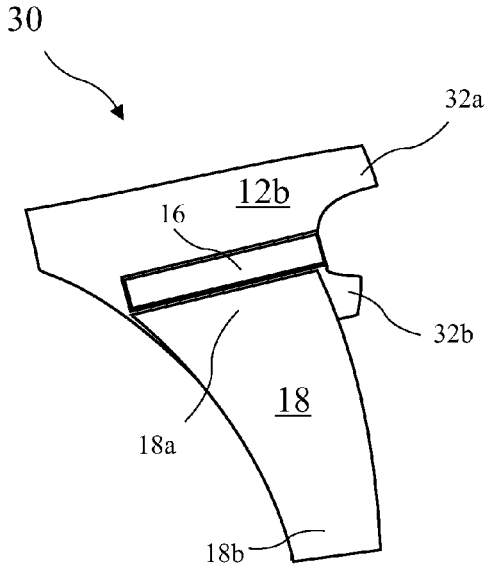
FIG. 5A is a front view of a palm harness with the stop and the resilient pad according to the present invention.
Figure 5B:
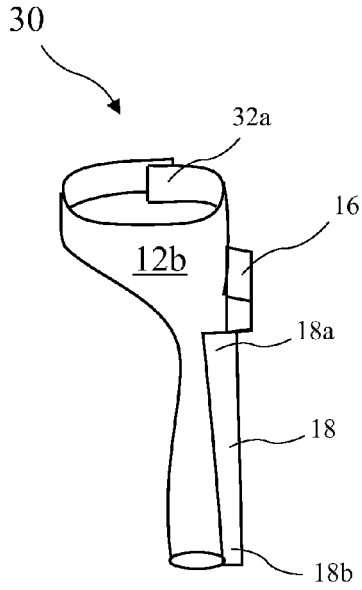
FIG. 5B is a side view of the palm harness with the stop and the resilient pad according to the present invention.

A front view of a palm harness 30 according to the present invention with the stop 16 and the resilient pad 18 is shown in FIG. 5A and a side view of the palm harness 30 with the stop and the resilient pad is shown in FIG. 5B. The palm harness 30 has a harness body 12*b* with straps 32*a* and 32*b* for holding the palm harness 30 on a golfer's hand. The straps 32*a* and 32*b* may be elastic and/or include Velcro® fasteners, buckles, snaps, or any other means of securing the straps around the golfer's hand. The narrow end 18*a* is about even with the distal joint of the index finger when the palm harness 30 is warn on the golfer's hand, or over a conventional golf glove warn on the golfer's hand.

While a glove 10 and a palm harness 30 have been described above, any hand wearable article including a body, straps, or other features for retaining the hand wearable article on a golfer's hand, and allowing the stop 16 to be attached to the hand wearable article and positioned as described above is intended to come within the scope of the present invention.

Figure 6B:
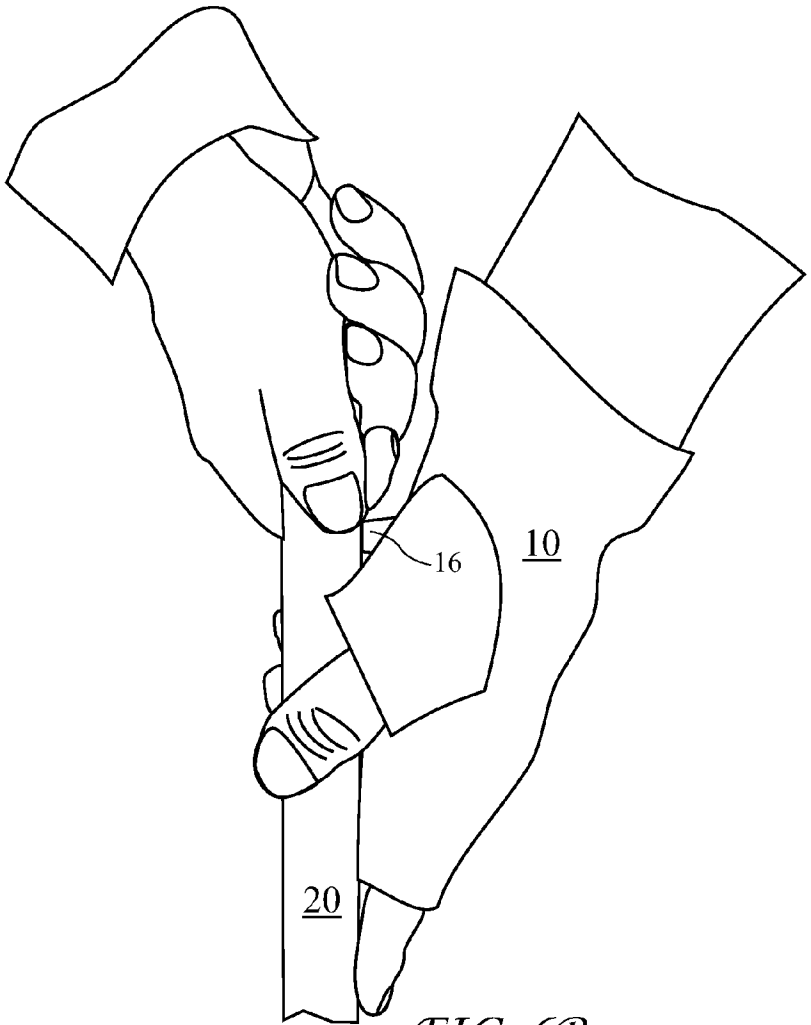
FIG. 6B shows a second view of the cross handed grip according to the present invention with the golf club handle abutted against the stop Corresponding reference characters indicate corresponding components throughout the several views of the drawings.
Figure 6A:
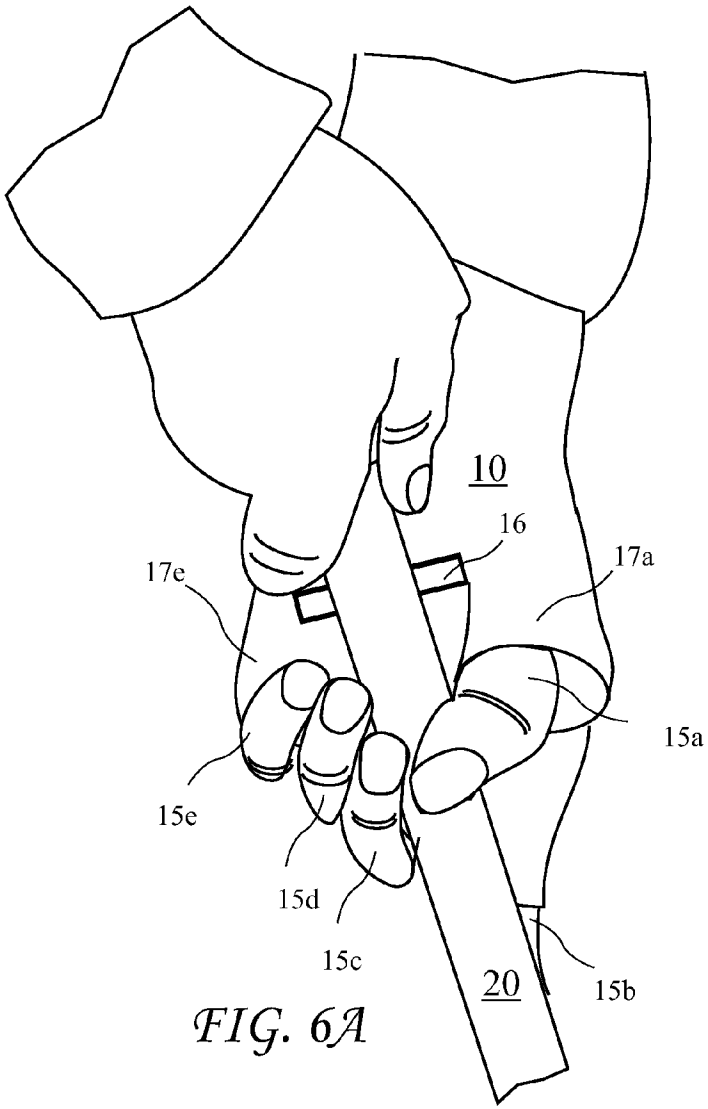
FIG. 6A shows a cross handed grip according to the present invention with the golf club handle resting against the stop

A cross handed grip according to the present invention with the golf club handle 20 resting against the stop 16 is shown in FIG. 6A and a second view of the cross handed grip according to the present invention with the golf club handle 20 abutted against the stop 16 is shown in FIG. 6B. The glove 10 facilitates the use of the cross handed grip for putting by providing the stop 16 to firmly rest the golf club handle 20 against.

While the invention herein disclosed has been described by means of specific embodiments and applications thereof, numerous modifications and variations could be made thereto by those skilled in the art without departing from the scope of the invention set forth in the claims.

I claim:

1. A golf club handle stabilizer comprising:

a hand wearable article configured for wearing on a golfer's hand;

a stop attached to the hand wearable article and positionable on a palm of the golfer's hand reaching across the palm from near the base of a thumb of the golfer's hand and angled away from the horizontal towards a base of a small finger when fingers of the golfer's hand are pointed downwards; and a wall of the stop facing the golfer's fingers, the wall approximately perpendicular to the golfer's palm when the hand wearable article is worn on the golfer's hand, further including a resilient pad attached to the hand wearable article and extending from a wide end of the resilient pad proximal to the wall of the stop to a narrow end of the resilient pad residing along an index finger of the golfer wearing the article, the resilient pad for filling a gap between the golfer's palm and the golf club handle to provide a firm grasp.

2. The golf club handle stabilizer of claim 1, wherein the wearable article is a golf glove.

3. The golf club handle stabilizer of claim 2, wherein the wearable article is a golf glove without finger ends.

4. The golf club handle stabilizer of claim 1, further including a resilient pad attached to the hand wearable article and extending from a wide end of the resilient pad proximal to the wall of the stop to a narrow end of the resilient pad residing along an index finger of the golfer wearing the article, the resilient pad for filling a gap between the golfer's palm and the golf club handle to provide a firm grasp.

5. The golf club handle stabilizer of claim 1, wherein:

the wide end of the resilient pad is between ⅜ inches to ½ inches thick and between 1.5 and three inches wide; and the narrow end of the resilient pad is between 3/16 inches to 5/16 inches thick and between ¾ and 1.5 inches wide.

6. The golf club handle stabilizer of claim 1, wherein the wide end of the resilient pad is about 2.5 inches wide and the narrow end of the resilient pad is about one inch wide.

7. The golf club handle stabilizer of claim 1, wherein the resilient pad extends along the index finger of the golfer's hand and ends proximal to the distal joint of the index finger.

8. The golf club handle stabilizer of claim 1, wherein the resilient pad has a convex bottom for filling a hollow of the golfer's hand.

9. The golf club handle stabilizer of claim 1, wherein the narrow end of the resilient pad is about even with the distal joint of the index finger when the hand wearable article is warn on the golfer's hand.

10. The golf club handle stabilizer of claim 1, wherein the resilient pad is made from a compressible material.

11. The golf club handle stabilizer of claim 1, wherein the hand wearable article is engaged by an index finger of the golfer's hand when worn on the golfer's hand for correctly positioning the stop on the palm of the golfer's hand.

12. The golf club handle stabilizer of claim 1, wherein the stop is between two and three inches long.

13. A golf club handle stabilizer comprising:

a golf glove configured for wearing on a golfer's hand;

a stop attached to the golf glove and positionable over a palm of the golfer's hand reaching across the palm from near the base of a thumb of the golfer's hand and angled away from the horizontal towards a base of a small finger when fingers of the golfer's hand are pointed downwards;

a wall of the stop facing the golfer's fingers, the wall approximately perpendicular to the golfer's palm when the golf glove is worn on the golfer's hand; and a resilient pad attached to the golf glove and extending from a wide end of the resilient pad proximal to the face of the stop to a narrow end of the resilient pad residing along an index finger of the golfer wearing the golf glove, the resilient pad for filling a gap between the golfer's palm and the golf club handle to provide a firm grasp.

* * * * *